US012484699B2

(12) United States Patent
Wang

(10) Patent No.: US 12,484,699 B2
(45) Date of Patent: Dec. 2, 2025

(54) FIVE-POINTED-STAR-SHAPED BASE ADAPTED TO DISASSEMBLE AND ASSEMBLE

(71) Applicant: ZHEJIANG ANJI SHENGXING TECHNOLOGY CO., LTD., Huzhou (CN)

(72) Inventor: Zhilong Wang, Huzhou (CN)

(73) Assignee: ZHEJIANG ANJI SHENGXING TECHNOLOGY CO., LTD., Huzhou (CN)

( * ) Notice: Subject to any disclaimer, the term of this patent is extended or adjusted under 35 U.S.C. 154(b) by 0 days.

(21) Appl. No.: 18/292,985

(22) PCT Filed: Dec. 5, 2022

(86) PCT No.: PCT/CN2022/136563
§ 371 (c)(1),
(2) Date: Jan. 29, 2024

(87) PCT Pub. No.: WO2023/103957
PCT Pub. Date: Jun. 15, 2023

(65) Prior Publication Data

US 2024/0324781 A1 Oct. 3, 2024

(30) Foreign Application Priority Data

Dec. 6, 2021 (CN) ..... 202111475183.9

(51) Int. Cl.
*A47C 7/00* (2006.01)

(52) U.S. Cl.
CPC ..... *A47C 7/004* (2013.01)

(58) Field of Classification Search
CPC ..... A47C 7/004; A47B 91/00; A47B 91/022
See application file for complete search history.

(56) References Cited

U.S. PATENT DOCUMENTS 3,801,054 A * 4/1974 Glowacki ..... F16B 12/52 248/188.7
2015/0122958 A1* 5/2015 Chen ..... A47C 7/004 248/158

FOREIGN PATENT DOCUMENTS

CN 201509927 U 6/2010
GB 1426344 A * 2/1976 ..... A47C 7/004
JP 3188630 U * 1/2014

(Continued)

OTHER PUBLICATIONS

PCT International Search Report for PCT International Application No. PCT/CN2022/136563.

(Continued)

*Primary Examiner* — Kimberly T Wood
(74) *Attorney, Agent, or Firm* — Olive Law Group, PLLC

(57) ABSTRACT

A five-pointed-star-shaped base adapted to disassemble and assemble includes a pedestal and a plurality of supporting feet detachably connected with the pedestal. The pedestal includes a body, a top cap and a bottom cap, all of which are connected. A top of the body is detachably connected with a top of the top cap, and a bottom of the body is fixed to or detachably connected with the bottom cap. The body is of a hollow sleeve structure, an upper cavity is formed between a bottom inner wall of the top cap and an outer wall of the body, and a lower cavity is formed between an inner wall of the bottom cap and the outer wall of the body.

6 Claims, 5 Drawing Sheets

(56) References Cited

FOREIGN PATENT DOCUMENTS

| | | | |
|---|---|---|---|
| TW | M607172 | U | 9/2020 |
| WO | 2004049871 | A1 | 6/2004 |

OTHER PUBLICATIONS

PCT Written Opinion for PCT International Application No. PCT/CN2022/136563.

* cited by examiner

FIVE-POINTED-STAR-SHAPED BASE ADAPTED TO DISASSEMBLE AND ASSEMBLE

CROSS REFERENCE TO RELATED APPLICATIONS

This is a 371 application of PCT International Patent Application No. PCT/CN2022/136563, filed on Dec. 5, 2022, which claims priority to Chinese Patent Application No. CN 202111475183.9, filed on Dec. 6, 2021; the contents of which are incorporated herein by reference in their entireties.

TECHNICAL FIELD

The present disclosure relates to the technical field of five-pointed-star-shaped base supporting seat structures, in particular to a five-pointed-star-shaped base adapted to disassemble and assemble.

BACKGROUND ART

In the table and chair furniture industry, five-pointed-star-shaped base supporting seats are often used to ensure the supporting effect, which cooperate with cylinders, universal wheels and other structures thereon, to achieve height adjustment, steering and other auxiliary functions. At present, common five-pointed-star-shaped base supporting seats mainly include two categories: the first is an integrated type; and the second is a disassembly and assembly type including pedestals and supporting feet. The former has the problem of large occupied space for transportation and storage, while the latter has the problem that disassembly and assembly convenience and connection strength are difficult to coordinate, so it is urgently necessary to develop a five-pointed-star-shaped base supporting seat that is adapted to disassemble and assemble and high in connection strength in the industry.

SUMMARY

Technical Problem

According to the five-pointed-star-shaped base structure as disclosed above, the supporting legs and the pedestal are clamped simply, the pedestal is of an integrated structure, force is concentrated on the connection blocks during use, easily resulting in deformation of the connection blocks, the connection blocks are hardly maintained at the later stage, and therefore certain potential safety hazards are generated while the service life is affected.

Technical Solution

The present disclosure provides a five-pointed-star-shaped base stable in structure, safe and reliable, and adapted to operate in order to overcome the defects in the prior art.

In order to achieve the above disclosure objectives, the present disclosure adopts the following technical solution: A five-pointed-star-shaped base adapted to disassemble and assemble, includes a pedestal and a plurality of supporting feet detachably connected with the pedestal; the pedestal includes a body, a top cap and a bottom cap, all of which are connected; a top of the body is detachably connected with a top of the top cap, and a bottom of the body is fixed to or detachably connected with the bottom cap; the body is of a hollow sleeve structure, an upper cavity is formed between a bottom inner wall of the top cap and an outer wall of the body, and a lower cavity is formed between an inner wall of the bottom cap and the outer wall of the body; the upper cavity is opposite to the lower cavity, clamping pieces are arranged at ends of the supporting feet, and upper and lower ends of the clamping pieces are embedded into the upper cavity and the lower cavity respectively; side edges of the adjacent clamping pieces of the plurality of supporting feet abut against each other, and all the clamping pieces are sequentially connected to form an annular structure; and the body is of a circular truncated cone structure with a size gradually reduced from top to bottom.

As a preferred solution of the present disclosure, external threads are formed at the top and the bottom of the body, an internal thread matched with the corresponding external thread is formed on a top inner wall of the top cap, and an internal thread matched with the corresponding external thread is formed on a bottom inner wall of the bottom cap.

As a preferred solution of the present disclosure, an external thread is formed at the top of the body, an internal thread matched with the external thread is formed on a top inner wall of the top cap, and the bottom cap and the body are of an integrated structure.

As a preferred solution of the present disclosure, an interval between the top cap and the bottom cap is matched with heights of the clamping pieces.

As a preferred solution of the present disclosure, upper chucking rings are arranged between the top cap and the clamping pieces, and inner and outer sides of the upper chucking rings abut against outer walls of the clamping pieces and an inner wall of the top cap respectively.

As a preferred solution of the present disclosure, the bottom cap includes a positioning bottom plate and a positioning side plate, the positioning bottom plate is flush with the bottom of the body, and the positioning side plate is arranged around the positioning bottom plate.

As a preferred solution of the present disclosure, lower chucking rings are arranged between the positioning side plate and the clamping pieces, and inner and outer sides of the lower chucking rings abut against outer walls of the clamping pieces and an inner wall of the positioning side plate respectively.

As a preferred solution of the present disclosure, the positioning side plate is formed along an outer ring edge of the positioning bottom plate, the positioning side plate is arranged in an axial direction of the body, and the positioning side plate is arranged towards the top cap.

As a preferred solution of the present disclosure, the ends of the supporting feet are connected to middles of the clamping pieces, the clamping pieces are of arc-shaped structures matched with the outer wall of the body, and fillets are formed on top outer walls of the clamping pieces.

As a preferred solution of the present disclosure, side faces of the clamping pieces of the adjacent supporting feet abut against each other.

BENEFICIAL EFFECTS

Compared with the prior art, the present disclosure has the beneficial effects: the upper cavity and the lower cavity are obtained by arranging the bottom cap and the top cap which are of edge covered structures at the bottom and the top of the body respectively, and the clamping pieces of the supporting feet are put in the upper cavity and the lower cavity, such that the clamping pieces can be positioned in a vertical direction; meanwhile, due to the arrangement of the clamping pieces, the clamping pieces are positioned in a horizontal direction by abutting between the adjacent clamping pieces; and the top cap and the bottom cap are both detachably connected with the body through the threads, the supporting feet and the body can be disassembled by screwing off the top cap, and the bottom cap can be conveniently installed on the body to form the pedestal of the body.

Figure 1:
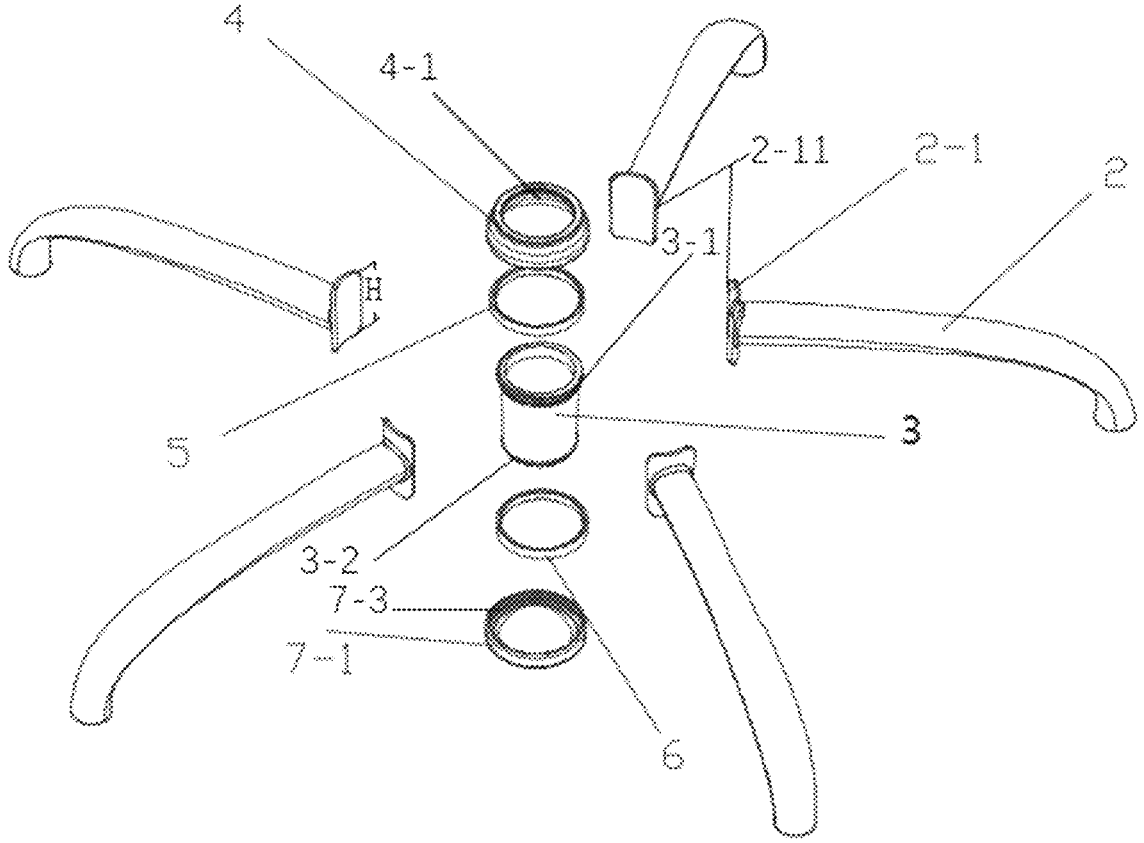
FIG. 1 is an exploded diagram of the present disclosure.

Reference signs: pedestal 1, supporting foot 2, clamping piece 2-1, side edges 2-11, height of clamping piece H, body 3, an external thread at the top of body 3-1, an external thread at the bottom of body 3-2, top cap 4, an internal thread of top cap 4-1, upper chucking ring 5, lower chucking ring 6, bottom cap 7, positioning bottom plate 7-1, positioning side plate 7-2, an internal thread of bottom cap 7-3, upper cavity UC, lower cavity LC, and fillet 8.

DETAILED DESCRIPTION OF THE EMBODIMENTS

The embodiments of the present disclosure will be described below in detail with reference to the drawings.

Figure 2:
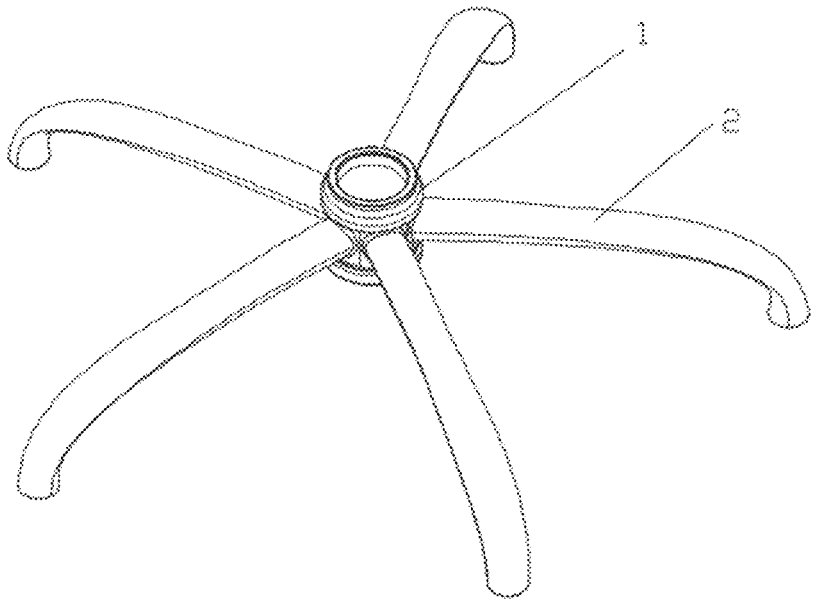
FIG. 2 is a schematic structural diagram of the present disclosure.
Figure 3:
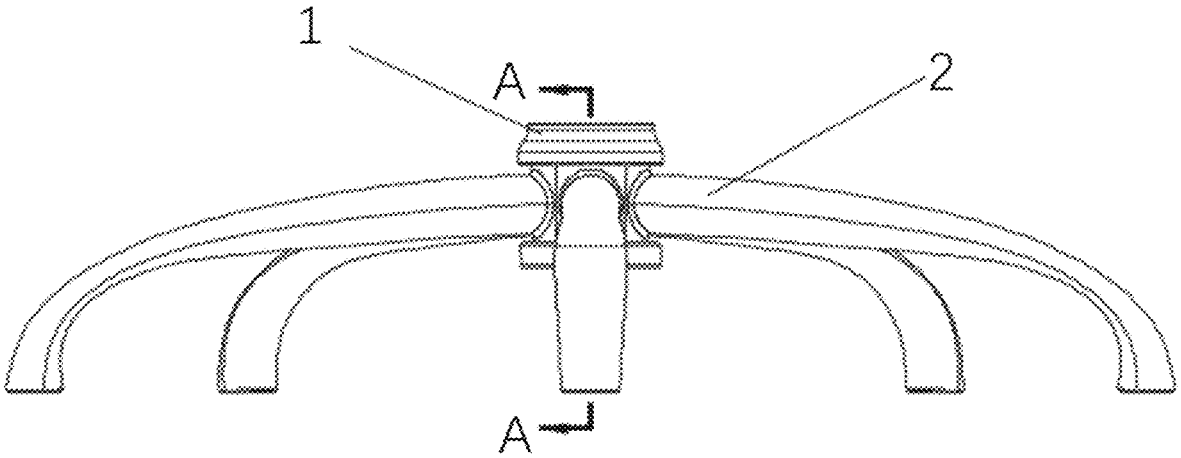
FIG. 3 is a front view of the present disclosure.
Figure 4:
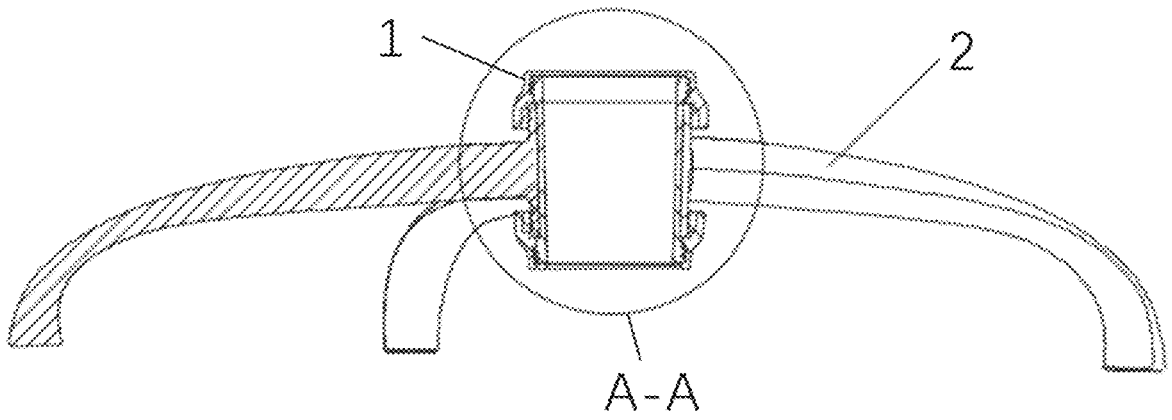
FIG. 4 is a section view of Embodiment 1.
Figure 5:
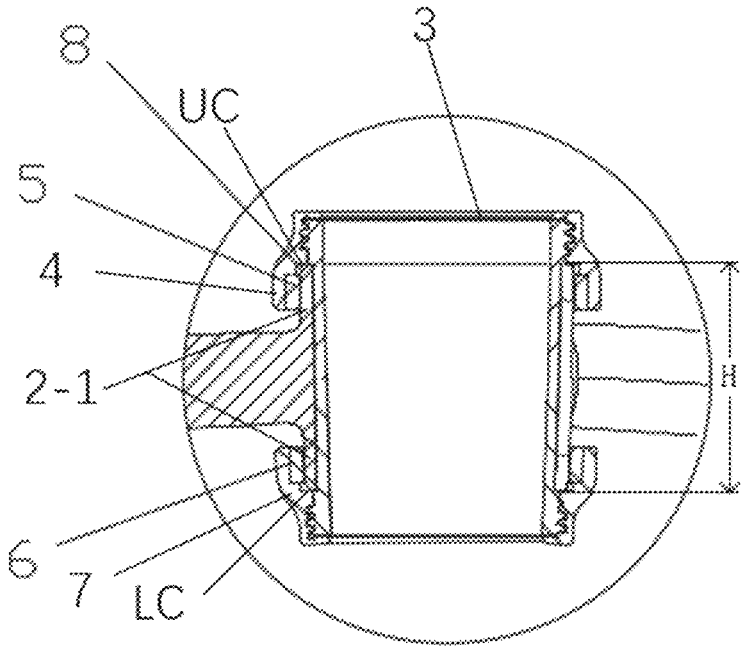
FIG. 5 is a partial enlarged view in FIG. 4.
Figure 6:
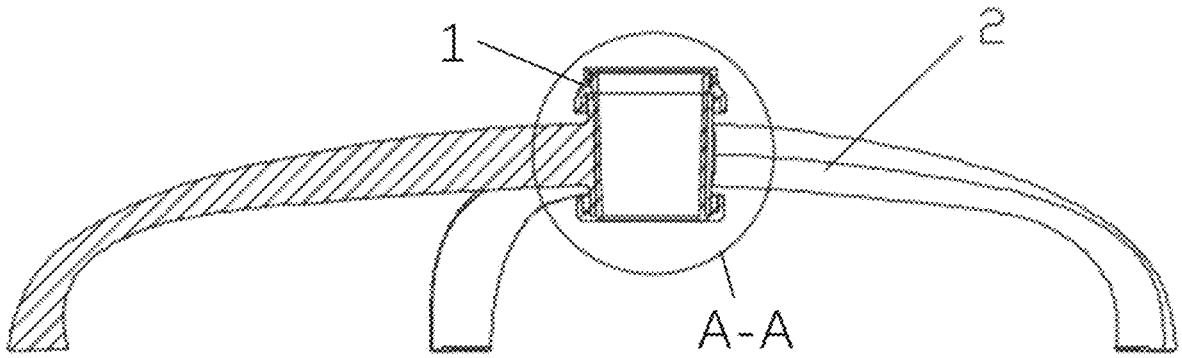
FIG. 6 is a section view of Embodiment 2.
Figure 7:
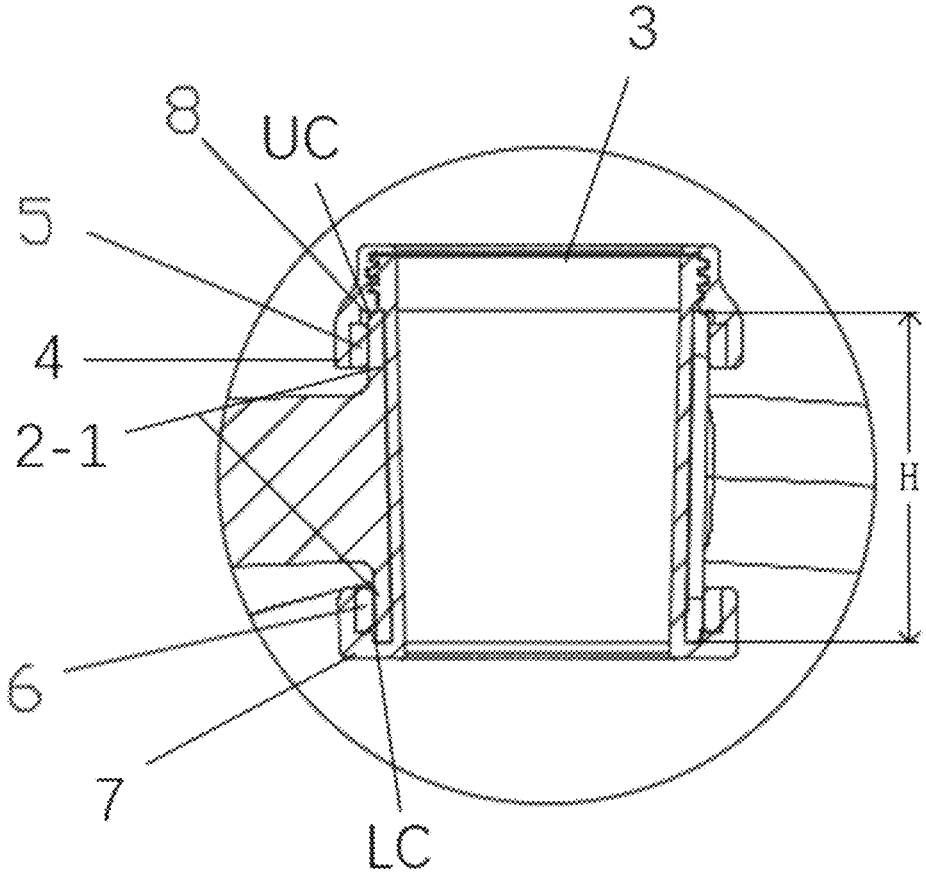
FIG. 7 is a partial enlarged view in FIG. 6.
Figure 8:
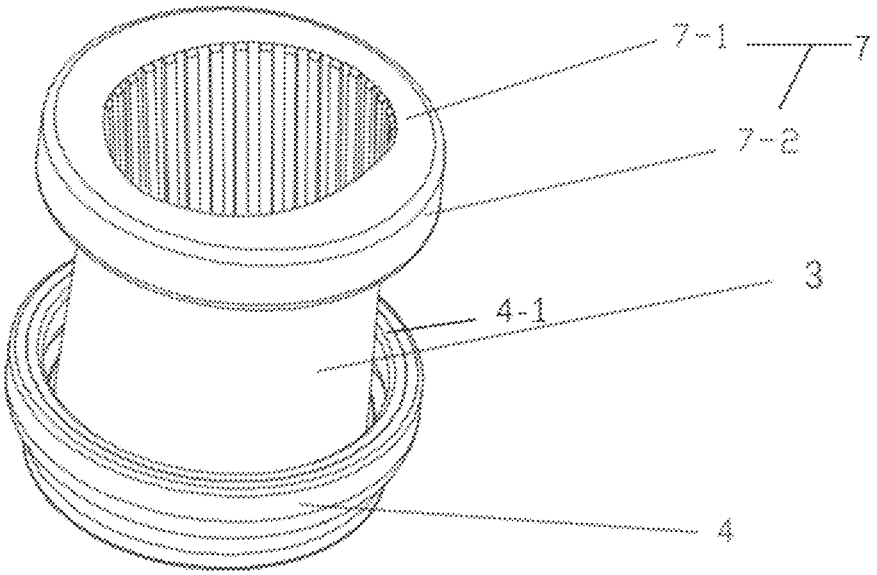
FIG. 8 is a schematic structural diagram of a bottom cap.

As shown in FIGS. 1-8, a five-pointed-star-shaped base adapted to disassemble and assemble, includes a pedestal 1 and a plurality of supporting feet 2 detachably connected with the pedestal; the pedestal 1 includes a body 3 and a top cap 4 connected with the body, and a top of the body 3 is detachably connected with a top of the top cap 4; the body 3 is of a hollow circular truncated cone structure with a size gradually reduced from top to bottom, the top of the top cap 4 is tightly connected to the top of the body 3, and an upper cavity UC is formed between a bottom inner wall of the top cap 4 and an outer wall of the body 3; a bottom cap 7 is formed at a bottom of the body 3, and the bottom cap 7 includes a positioning bottom plate 7-1 and a positioning side plate 7-2; the positioning bottom plate 7-1 is connected with the bottom of the body 3, the positioning side plate 7-2 is arranged around the positioning bottom plate 7-1, and a lower cavity LC is formed between the positioning side plate 7-2 and the outer wall of the body 3; clamping pieces 2-1 are arranged at ends of the supporting feet 2, and upper and lower ends of the clamping pieces 2-1 are embedded into the upper cavity UC and the lower cavity LC respectively; and side edges 2-11 of the adjacent clamping pieces 2-1 of the plurality of supporting feet 2 abut against each other, and all the clamping pieces 2-1 are sequentially connected to form an annular structure.

Embodiment 1: The top cap 4 and the bottom cap 7 are both connected with the body 3 through threads, external threads 3-1, 3-2 are formed at the top and the bottom of body 3, an internal thread 4-1 matched with the corresponding external thread 3-1 is formed on a top inner wall of the top cap 4, and an internal thread 7-3 matched with the corresponding external thread 3-2 is formed on a bottom inner wall of the bottom cap 7.

At this time, the top cap 4 and the bottom cap 7 are both detachably connected with the body 3; and during actual use, the supporting feet 2 are sequentially put after the bottom cap 7 is connected to the bottom of the body 3, the clamping pieces 2-1 of the supporting feet 2 are embedded into the lower cavity LC formed between the bottom cap 7 and the body 3, as a result, the upper ends of the clamping pieces 2-1 are tightly attached to the body 3 under the action of gravity of the body 3 since the body 3 is in an overhead state, such that the top cap 4 can be conveniently installed, thereby making the clamping pieces 2-1 automatically and tightly attached to the outer wall of the body 3.

The whole five-pointed-star-shaped base can be installed after the top cap 4 is screwed on.

Embodiment 2: The top cap 4 is connected to the body 3 through threads, an external thread 3-1 is formed at the top of the body 3, an internal thread 4-1 matched with the external thread 3-1 is formed on the top inner wall of the top cap 4, and the bottom cap 7 and the body 3 are of an integrated structure.

At this time, the top cap 4 is detachably connected with the body 3, and the bottom cap 7 is fixedly connected with the body 3; and during actual use, the supporting feet 2 are sequentially put after the bottom cap 7 is connected to the bottom of the body 3, the clamping pieces 2-1 of the supporting feet 2 are embedded into the lower cavity LC formed between the bottom cap 7 and the body 3, as a result, the upper ends of the clamping pieces 2-1 are tightly attached to the body 3 under the action of gravity of the body 3 since the body 3 is in an overhead state, such that the top cap 4 can be conveniently installed, thereby making the clamping pieces 2-1 automatically and tightly attached to the outer wall of the body 3.

The whole five-pointed-star-shaped base can be installed after the top cap 4 is screwed on.

Embodiment 1 is taken as a preferred embodiment of the present application.

Compared with Embodiment 1, since the body 3 is usually made of plastic, during production in Embodiment 2, when the bottom cap 7 and the body 3 need to be injection-moulded into an integrated structure, mould release between the bottom cap 7 and the body 3 is hardly achieved in the process, thereby affecting connection between the bottom cap 7 and the body 3; and a threaded connection manner in Embodiment 1 is rapid and convenient, and the structure is simple and convenient.

Five supporting feet 2 are arranged on the pedestal 1, which are arranged circumferentially with a center of the pedestal 1 as a circle center. The clamping pieces 2-1 between the adjacent supporting feet 2 abut against each other, the clamping pieces 2-1 are of rectangular sheet structures, the upper and lower ends of the clamping pieces 2-1 are positioned in a vertical direction under the action of the upper cavity UC and the lower cavity LC, the clamping pieces 2-1 are positioned in a horizontal direction under the action of the clamping pieces 2-1 adjacent thereto, and therefore the clamping pieces 2-1 are stably embedded into the pedestal 1.

An external thread 3-1 is formed on the top of the body 3, an internal thread 4-1 matched with the external thread 3-1 is formed on a top inner wall of the top cap 4, the body 3 is connected with the top cap 4 through the threads, and a limiting edge that extends inwards is formed on a top of the top cap 4; and after the top cap 4 is screwed onto the body 3 to a certain degree, deepest thread positions of the top cap and the body are achieved under the action of the limiting edge.

The body 3 is of a circular truncated cone structure with a size reduced from top to bottom, a matching groove matched with an air rod can be formed in the body 3, and the body 3 with the size reduced from top to bottom can clamp and position an end of the air rod in an insertion process of a cylinder; an interval between the top cap 4 and the bottom cap 7 is matched with heights H of the clamping pieces 2-1, the top cap 4 can be divided into a thread section at an upper end and a matching section at a lower end, the thread section and the matching section are both of a circular ring structure, an oblique bevel edge is formed at a joint between the thread section and the matching section, and a size of the thread section is less than that of the matching section; and therefore when the thread section is connected to the body 3 through threads, a gap, namely the upper cavity UC, exists between the matching section and the body 3.

Upper chucking rings 5 are arranged between the top cap 4 and the clamping pieces 2-1, inner and outer sides of the upper chucking rings 5 abut against outer walls of the clamping pieces 2-1 and an inner wall of the top cap 4 respectively, the upper chucking rings 5 are located in the upper cavity UC, the upper chucking rings 5 are in interference fit with the clamping pieces 2-1, and therefore the clamping pieces 2-1, the upper chucking rings 5 and the top cap 4 are fixedly connected under the action of friction force.

Lower chucking rings 6 are arranged between the positioning side plate 7-2 and the clamping pieces 2-1, inner and outer sides of the lower chucking rings 6 abut against the outer walls of the clamping pieces 2-1 and an inner wall of the positioning side plate 7-2 respectively, the lower chucking rings 6 are located in the lower cavity LC, the lower chucking rings 6 are in interference fit with the clamping pieces 2-1, and therefore the clamping pieces 2-1, the lower chucking rings 6 and the positioning side plate 7-2 are fixedly connected under the action of friction force.

The positioning bottom plate 7-1 is flush with the bottom of the body 3, the positioning bottom plate 7-1 is arranged in a radial direction of the body 3, the positioning bottom plate 7-1 is of a circular ring structure, and a width of the positioning bottom plate 7-1 is set according to sizes of the clamping pieces 2-1 and the lower chucking rings 6. The positioning side plate 7-2 is formed along an outer ring edge of the positioning bottom pate 7-1, the positioning side plate 7-2 is arranged in an axial direction of the body 3, and the positioning side plate 7-2 is arranged towards the top cap 4.

The ends of the supporting feet 2 are connected to middles of the clamping pieces 2-1, the clamping pieces 2-1 are of arc-shaped structures matched with the outer wall of the body 3, and the ends of the supporting feet 2 are fixedly connected to the middles of the clamping pieces 2-1 in a welded manner. Fillets 8 are formed on top outer walls of the clamping pieces.

The upper and lower ends of the clamping pieces 2-1 abut against the external threads 3-1, 3-2 of the body 3 and the positioning bottom plate 7-1 respectively.

Different numbers of supporting feet 2 can be arranged on the pedestal 1 according to actual needs. An angle of the clamping pieces 2-1 is determined by dividing 180° by the number of the supporting feet 2, for example, when five supporting feet 2 are connected to the pedestal 1, the clamping pieces 2-1 form arc-shaped structures with the angle of 36°, vertical structures are formed on two sides of the clamping pieces 2-1, the clamping pieces 2-1 on all the supporting feet 2 are connected into a ring accordingly, and the adjacent clamping pieces 2-1 abut against each other, thereby achieving better stability.

During actual use, firstly, the lower chucking rings 6 are put in the lower cavity LC, then the clamping pieces 2-1 of the supporting feet 2 are put on the body 3, as a result, bottoms of the clamping pieces 2-1 are put in the lower cavity LC, the clamping pieces 2-1 are embedded between the lower chucking rings 6 and the outer wall of the body 3, and surfaces of the clamping pieces 2-1 are tightly attached to the outer wall of the body 3 under the action of the arc-shaped structures.

The clamping pieces 2-1 of the supporting feet 2 are sequentially put, such that the clamping pieces 2-1 of all the supporting feet 2 are connected into a ring. Then the upper chucking rings 5 are put in the top cap 4, the upper chucking rings 5 are in interference fit with the top cap 4, and therefore the upper chucking rings 5 are fixedly connected with the top cap 4, The top cap 4 sleeves the body 3, as a result, tops of the clamping pieces 2-1 are embedded between the upper chucking rings 5 and the outer wall of the body 3.

The bottom cap 7 and the top cap 4 are used for positioning and pressing the upper and lower ends of the clamping pieces 2-1, and the whole supporting feet 2 are stably arranged due to abutting between the adjacent clamping pieces 2-1.

When the whole body needs to be disassembled, the supporting pieces 2-1 can be lifted to be separated from the body 3 only by unscrewing the top cap 4 from the body 3, thereby achieving disassembly of the whole body.

Those skilled in the art can achieve or use the present disclosure according to the above description of the disclosed embodiments. Various modifications to these embodiments will be apparent to those skilled in the art, and general principles defined herein can be achieved in other embodiments without departing from the spirit or scope of the present disclosure. Thus, the present disclosure will not be limited to these embodiments shown herein, but will conform to the widest scope consistent with principles and novel features disclosed herein.

Although terms shown in reference signs: pedestal 1, supporting foot 2, clamping piece 2-1, body 3, top cap 4, upper chucking ring 5, lower chucking ring 6, bottom cap 7, positioning bottom plate 7-1, positioning side plate 7-2, fillet 8, etc. in the figures are used herein, the possibility of using other terms cannot be excluded. These terms are used merely to more conveniently describe and explain the essence of the present disclosure. To interpret them as any additional limitation is contrary to the spirit of the present disclosure.

What is claimed is:

1. A five-pointed-star-shaped base adapted to disassemble and assemble, comprising a pedestal and a plurality of supporting feet detachably connected with the pedestal; wherein the pedestal comprises a body, a top cap and a bottom cap; a top of the body is detachably connected with a top of the top cap, and a bottom of the body is fixed to or detachably connected with the bottom cap; the body is of a hollow sleeve structure, an upper cavity is formed between a bottom inner wall of the top cap and an outer wall of the body, and a lower cavity is formed between an inner wall of the bottom cap and the outer wall of the body, the upper cavity is opposite to the lower cavity; clamping pieces are arranged at ends of the supporting feet, and upper and lower ends of the clamping pieces are embedded into the upper cavity and the lower cavity respectively; side edges of the adjacent clamping pieces of the plurality of supporting feet abut against each other, and all the clamping pieces are sequentially connected to form an annular structure; and the body is of a circular truncated cone structure with a size gradually reduced from top to bottom;

upper chucking rings are arranged between the top cap and the clamping pieces, and inner and outer sides of the upper chucking rings abut against outer walls of the clamping pieces and an inner wall of the top cap respectively, the bottom cap comprises a positioning bottom plate and a positioning side plate, the positioning bottom plate is flush with the bottom of the body, and the positioning side plate is arranged around the positioning bottom plate;

lower chucking rings are arranged between the positioning side plate and the clamping pieces, and inner and outer sides of the lower chucking rings abut against outer walls of the clamping pieces and an inner wall of the positioning side plate respectively.

2. The five-pointed-star-shaped base adapted to disassemble and assemble according to claim 1, wherein external threads are formed at the top and the bottom of the body, an internal thread matched with the corresponding external thread is formed on a top inner wall of the top cap, and an internal thread matched with the corresponding external thread is formed on a bottom inner wall of the bottom cap.

3. The five-pointed-star-shaped base adapted to disassemble and assemble according to claim 1, wherein an external thread is formed at the top of the body, an internal thread matched with the external thread is formed on a top inner wall of the top cap, and the bottom cap and the body are of an integrated structure.

4. The five-pointed-star-shaped base adapted to disassemble and assemble according to claim 1, wherein an interval between the top cap and the bottom cap is matched with heights of the clamping pieces.

5. The five-pointed-star-shaped base adapted to disassemble and assemble according to claim 1, wherein the positioning side plate is formed on an outer ring edge of the positioning bottom plate, the positioning side plate is arranged in an axial direction of the body, and the positioning side plate is arranged towards the top cap.

6. The five-pointed-star-shaped base adapted to disassemble and assemble according to claim 1, wherein the ends of the supporting feet are connected to middles of the clamping pieces, the clamping pieces are of arc-shaped structures matched with the outer wall of the body, and fillets are formed on top outer walls of the clamping pieces.

* * * * *